US009346614B2

(12) United States Patent
Rosenkrantz

(10) Patent No.: US 9,346,614 B2
(45) Date of Patent: May 24, 2016

(54) INTERNAL FLOATING ROOF FOR COVERING FLUID BODIES IN STORAGE TANKS

(71) Applicant: David Jon Rosenkrantz, Emmaus, PA (US)

(72) Inventor: David Jon Rosenkrantz, Emmaus, PA (US)

( * ) Notice: Subject to any disclaimer, the term of this patent is extended or adjusted under 35 U.S.C. 154(b) by 0 days.

(21) Appl. No.: 14/264,646

(22) Filed: Apr. 29, 2014

(65) Prior Publication Data

US 2014/0231431 A1 Aug. 21, 2014

Related U.S. Application Data

(63) Continuation-in-part of application No. 13/490,230, filed on Jun. 6, 2012, now abandoned.

(51) Int. Cl.
*B65D 88/34* (2006.01)

(52) U.S. Cl.
CPC ..... *B65D 88/34* (2013.01)

(58) Field of Classification Search
CPC ..... E04B 9/00; B65D 88/34
USPC ..... 220/216–218, 622; 403/170; 52/665, 52/580, 648.1, 655.1, 729.1, 282.1, 653.1, 52/656.1; 14/77.1; 238/54–55; 1/216–218, 1/622
See application file for complete search history.

(56) References Cited

U.S. PATENT DOCUMENTS

| | | | |
|---|---|---|---|
| 2,039,602 | A | 5/1936 | Luebbe |
| 5,704,509 | A | 1/1998 | Rosenkrantz |
| 7,310,920 | B2 | 12/2007 | Hovey |
| 7,770,349 | B2 | 8/2010 | Tedesco et al. |

*Primary Examiner* — Anthony Stashick
*Assistant Examiner* — James M Van Buskirk
(74) *Attorney, Agent, or Firm* — Sanford J. Piltch, Esq.

(57) ABSTRACT

An internal floating roof for use in large volatile or hazardous liquid storage tanks constructed of a plurality of open-top panel systems including C-shaped beams each having a vertical sidewall and flanges extending inward along the top and bottom of the beams with a bottom flange extending the vertical wall downward beyond the bottom. The panel systems are secured together using top and bottom brackets to construct a rigid, non-flexing roof structure to contain the hazardous gases and vapors beneath the floating roof without creating alternative escape pathways along the respective joints or seams between the panel systems. An additional seal in the form of a weld or resilient sealing member may be used along the joint between adjacent beams to further secure against leaking.

10 Claims, 4 Drawing Sheets

INTERNAL FLOATING ROOF FOR COVERING FLUID BODIES IN STORAGE TANKS

RELATED U.S. APPLICATION DATA

The present invention is a continuation-in-part of U.S. non-provisional patent application Ser. No. 13/490,230 filed on Jun. 6, 2012, now abandoned.

BACKGROUND OF THE INVENTION

The present invention relates to an internal floating roof located atop a fluid body in a fluid storage tank. Bulk fluids such as petroleum and other liquid fuel and chemical products are often stored in large cylindrical tanks. These tanks are commonly designed with internal floating roofs or covers to minimize product losses through leakage or evaporation to the atmosphere. The present invention describes a floating roof that is comprised of integral panels having a lower profile than existing floating roofs.

A large number of industrial processes require the use of substantial quantities of volatile liquids such as gasoline, alcohol, etc. The industries utilizing these processes store a wide range of volatile liquids in large storage vessels. The storage vessels are typically constructed of steel, stainless steel, aluminum and reinforced concrete, among other construction materials, depending upon the size and location of the storage vessel, the material stored inside the tank, and the industrial process generating or using the contained liquid. Many of these storage vessels have a fixed roof either integral with the vessel or retrofitted over the vessel for the dual purposes of keeping contaminants, e.g., water, dust and other particulate contaminants, out of the stored liquid and for reducing evaporative losses of the stored liquid for both economic and regulatory reasons. Storage vessels with a roof are commonly referred to as "covered" storage tanks.

If the liquid stored in the large-scale vessels is readily subject to evaporation at ambient pressure and temperature based upon their physical and chemical properties, additional control devices are commonly used to minimize losses from evaporation. Escaping vapors of many hydrocarbon based liquids can present health, safety or fire hazards. Vapors from flammable liquids can form an explosive mixture with air when an appropriate blend of stored liquid vapor and oxygen exists. Other liquids, particularly those containing sulfur, can present an objectionable odor when permitted to evaporate freely.

Over the years a variety of additional evaporative control devices have been utilized to control the escaping vapors from the liquids contained in the large-scale storage tanks. One common and effective variety of such control devices are liquid and vapor impervious buoyant structures that float on the liquid surface and are commonly referred to as "floating roofs." If the storage vessel is covered with a separate structural roof, the floating roof is denominated as an "internal" floating roof. If the storage vessel does not have a roof or cover, the floating roof is denominated as an "external" floating roof. An external floating roof serves the dual purposes of keeping weather and airborne contaminants away from the stored liquid and in reducing evaporative losses.

Although many different types of floating roofs have been manufactured, most fit into two categories: vapor space and full contact floating roofs. Vapor space floating roofs typically contain a plurality of closed and sealed buoyant members for supporting an impervious membrane above the liquid surface. The buoyant members create a vapor space between the liquid surface and the underside of the impervious membrane. If any mechanical joints, seams or holes exist or are created through continued use in the membrane, liquid vapors from the vapor space below the membrane can leak through the membrane to the ambient atmosphere above the membrane creating a potentially hazardous atmosphere as well as an evaporative condition for the stored liquid. Full contact floating roofs are configured with the membrane in substantial contact with the surface of the stored liquid eliminating any vapor space below the membrane. Such full-contact membranes are typically the lower portion of closed and sealed buoyant members. While this is an improvement in creating a floating barrier for retaining the liquid in a non-evaporative state, thus controlling evaporation, there still exists the problem of mechanical joints, seams and holes that provide points of leakage. Additionally, creating and testing the closed and sealed buoyant compartments requires specialty materials, highly skilled designers and fabricators while testing and maintaining these compartments involves additional skills and work.

Existing designs for full contact floating roofs fall into two broad categories, i.e., monolithic and segmented. The present invention falls into the category of a segmented floating roof. Segmented floating roofs are typically fabricated off site and assembled within the storage tank. Each of the plural segments is typically comprised of a composite panel with edge closures that facilitate assembly one to the other. The composite panel is a structural component comprising an upper and a lower strong relatively thin metallic skin separated by and bonded to a lightweight edge material that creates a box-like form for the panel. Within the composite panel may be a core comprised of, for example, polyurethane foam or honeycomb aluminum to fill the void between the top and bottom skins and to assist in the buoyancy of the floating roof. The edge materials are connected together along their top and/or bottom edges with, for example, bolts and nuts or, for another example with a retaining hook along the bottom of a first panel for holding a distending flange of a second panel within the hook of the first panel as described in U.S. Pat. No. 5,704,509.

This description of a composite panel floating roof is provided to afford the reader with a reasonable understanding of the types of construction used in presently available floating roofs. However, there remain structural flaws that need to be addressed to further reduce evaporation, collection of volatile gases below and in the enclosed panel spaces, and reduce the vertical height to achieve less overall weight increasing the buoyancy and permitting greater storage capacity in the tank.

One of the noticed problems with the present designs for floating roof panels is the penetration through the hook and distending flange attachment between panels. This type of attachment arrangement permits the slow leakage (evaporation) of the contained liquid upward through any joint that is not rigidly held in absolute parallel to its adjoining edge member. Further, the hook may allow for some slippage away from the rigid joint through continued use. It is, therefore, an object of the present invention to eliminate the potential for slippage of adjoining panel edges away from one another by substituting a securing member for holding the edge joint in rigid contact along its entire length.

Another of the problems with the present designs for floating roof panels is the presence of fasteners in a potential vapor escape path that allow the passage of vapors to the space above the floating roof. The present invention eliminates the need for such fasteners or connections.

Another of the problems is the leakage of the liquid and/or vapors into the interior space of the composite panel creating a potentially hazardous condition and defeating the buoyancy characteristics for that panel. The present invention eliminates the top skin which, in turn, eliminates a potential collection space for harmful vapors in the core space of the panel. The present invention also eliminates the core material as the space between the edge members is now open to the ambient atmosphere. Thus, it is an object of the present invention to eliminate a collection space for harmful vapors by eliminating the upper skin and the core space. This, in turn, eliminates the need for buoyant core materials and allows for direct inspection of the bottom skin for leakage.

One other problem has been the additional buoyant members placed beneath the floating roof to maintain its buoyancy where required (typically at the outer edge of the floating roof where additional equipment is installed on top of the floating roof) and the subsequent loss of contact with the liquid surface. The buoyant members continually were in need of replacement as the liquids contained in the tanks seeped into them and destroyed their buoyancy. The present invention is a full contact floating roof that does not require additional buoyant members for floating support. It is another object of the present invention to eliminate the need to test and inspect the main and additional buoyant members for content and/or replacement. It is another object off the present invention to reduce the vertical profile of the internal floating roof and gain the efficiencies of lesser height increasing the potential volumetric capacity of the tank or container.

One additional problem is vapor leakage through the elongated mechanical seams between the edge members of the panels. Evaporative leakage is a problem as vapors can build up in the ambient atmosphere within the tank above the floating roof. If the seams are not absolutely tight, vapor can leak between the adjoining surfaces of the edge members even if they look as if there is no visible space therebetween. The present invention eliminates this source of leakage by placing a sealing means along the entire elongated surface of adjoining panel edge members. In this way leakage due to poor sealing between edges or due to panel warpage is eliminated.

Other objects will appear hereinafter.

SUMMARY OF THE INVENTION

An internal floating roof system is described that comprises a series of interconnected panel systems including at least three or more C-shaped beams having an upper inwardly extending flange, a vertical wall section, a lower inwardly extending flange, and a bottom flange extending the vertical wall downward, a flat bottom panel extending across the space defined by the C-shaped beams of the panel system that is attached to the lower inwardly extending flanges of the C-shaped beams leaving the remaining upwardly extending internal space open to the atmosphere. The panel systems are attached together by a plurality of brackets for securing together adjacent panel systems at their respective top and bottom corners so that the adjacent panels are held in an abutting array. The brackets include an upper bracket overlying and secured to the upper inwardly facing flange of the C-shaped beams of each adjacent panel and a pair of lower brackets overlying and secured about the downwardly extending bottom flanges of the C-shaped beams of each adjacent panel. When totally secured in this fashion, the plurality of panel systems is retained in sealing engagement against each adjacent panel system along their common sidewalls.

The upper bracket or mounting plate is capable of overlying the junction of three or more adjacent panel systems and securing those panel systems together in abutting array along their respective sidewalls by securing or fastening means extending through the mounting plate or bracket and the upper inwardly extending flanges of the adjacent panel systems. Likewise, the lower brackets overlie the junction of three or more panel systems and securing those panel systems together in abutting array along their respective sidewalls by securing or fastening means extending through the lower brackets and the bottom flanges of the adjacent panel systems.

The internal floating roof composed of the panel systems may also include further sealing means along the top side of the abutting C-shaped beams to virtually eliminate any potential for gas or vapor emissions through the sidewall joint. The sealing means can be a running weld along the joint or a resilient sealing caulk or similar compound that is resistant to the stored liquid. The C-shaped sidewalls may be made from metals, such as aluminum, steel or stainless steel, or from extruded fiberglass, carbon or graphite composites or similar synthetic materials having suitable physical properties.

Additionally, the panel systems along the periphery of the array may be modified to have their outer walls curved to match the curvature of the containment vessel or tank. Each of the panel systems in the array forming the internal floating roof structure may have a differing, but similar, geometry in that all the panel systems in a single array forming the internal floating roof may take on a specific shape, e.g., rectangular or square, triangular, or hexagonal, or the array may be varied from all corner joints to an array that may appear like a stacked brick wall or take on a herring bone pattern.

BRIEF DESCRIPTION OF THE DRAWINGS

For the purpose of illustrating the invention, there is shown in the drawings forms which are presently preferred; it being understood, however, that the invention is not limited to the precise arrangements and instrumentalities shown.

DETAILED DESCRIPTION OF THE PREFERRED EMBODIMENTS

The following detailed description is of the best presently contemplated mode of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

Figure 1:
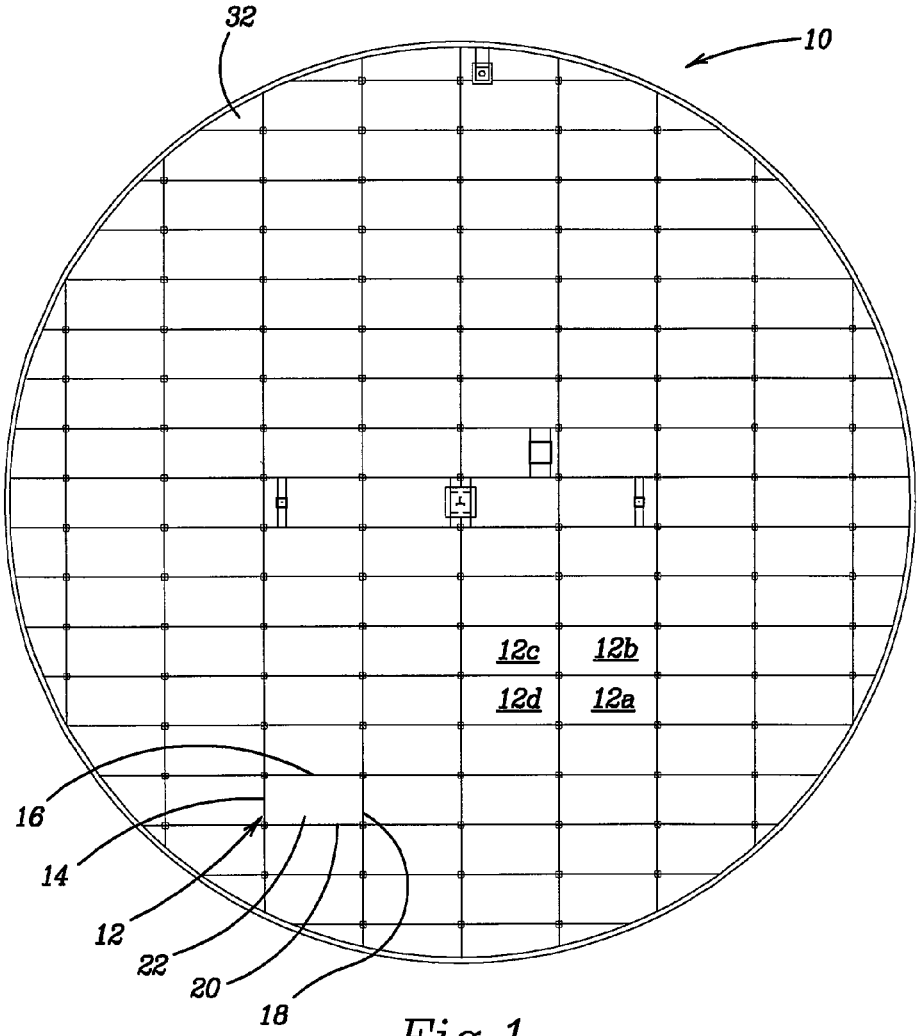
FIG. 1 is a top plan view of the internal floating roof of the present invention showing the panels arrayed in a checkerboard pattern.

Referring now to the drawings in detail, where like numerals refer to like parts or elements, there is shown in FIG. 1 the internal floating roof 10 of the present invention. The internal floating roof 10 is joined together from a plurality of individual reinforced panels such as the reinforced panel 12 indicated in FIG. 1. The reinforced panel system 12 is shown as a rectangular panel system, but other geometric shapes can be utilized, e.g. triangular, square, diamond or other parallelogram, hexagonal, etc. The reinforced panel system 12 is comprised of four C-shaped beams 14, 16, 18 and 20 arrayed around the perimeter of the panel system 12 with the open portion of the C facing inward towards the other beams forming the panel. In the rectangular form of the panel system 12, the C-shaped beams on opposite sides of the panel system are of the same length. Thus, C-shaped beams 14 and 18 are of the same length, as are beams 16 and 20. Each of the C-shaped beams is chamfered in relation to the next adjacent beam in order that their opposing ends can be joined together forming the rectangle without overlapping parts. Extending across the bottom of the panel system 12 and lying atop the lower inward facing portion of the C-shaped beams is a bottom plate 22 that extends across the entire space formed between the C-shaped beams overlapping a portion of the lower portion of the C-shaped beams. The bottom plate 22 is attached to each of the four C-shaped beams 14, 16, 18 and 20 along its perimeter forming a leak-proof panel system that is open on its top facing side.

Figure 2:
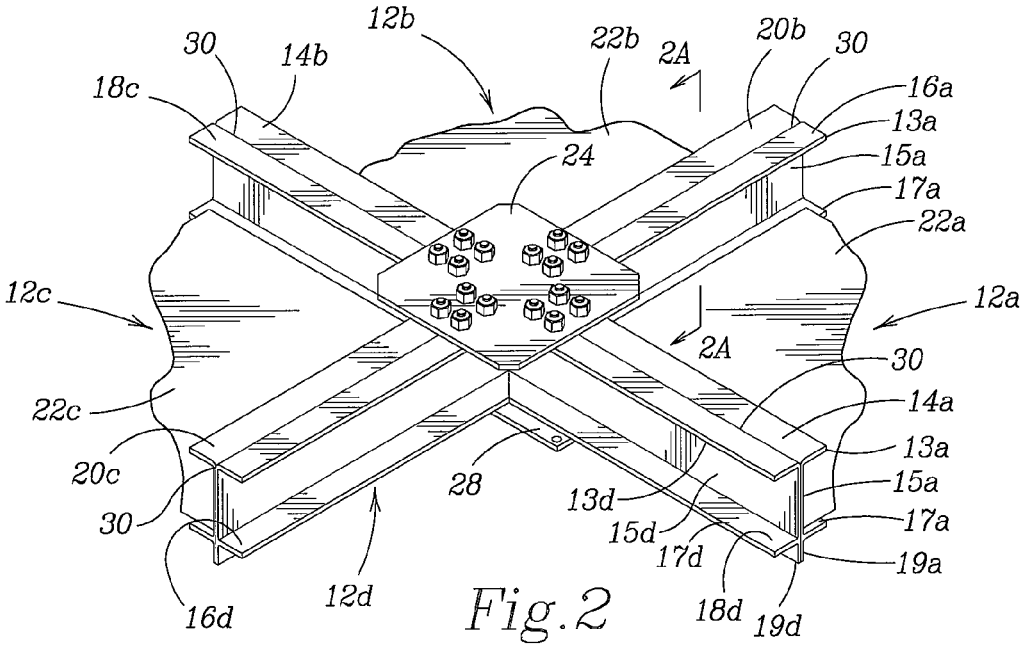
FIG. 2 is a perspective top view of the junction of four adjacent panel systems of the present invention with the bottom panel of the nearest panel system not shown to show the combined top and bottom attachment mechanism for retaining a rigid leak resistant floating roof.

For ease of understanding of the structural formation of each of the panel systems 12 and the method of retaining the rigidity required for structural integrity several adjacent panel systems 12*a*-12*d* have been marked in FIG. 1 to show the panels being described and their interconnection to each other. Reference should now be made to FIGS. 2, 2A and 3, 3A and the following description. In FIG. 2 there is shown the upper junction point of four adjacent panel systems 12. Starting with panel system 12*a*, the C-shaped beam 14*a* has an upper inwardly extending flange 13*a*, a vertical wall 15*a*, and a lower inwardly extending flange 17*a* forming the C-shape and a bottom flange 19*a* extending the vertical wall downward below the C-Shape. C-shaped beam 16*a* is similarly configured, as are the other two C-shaped beams of panel system 12*a* although not shown. The bottom plate 22*a* is attached to the lower inward extending flange of C-shaped beams 14*a*, 16*a*, as well as to the other two C-shaped beams, by a method of attachment that creates a leak-proof seal between the bottom plate 22*a* and each of the C-shaped beams 14*a*, 16*a* and the other two beams.

Likewise, the C-shaped beams 14*b*, 20*b* of panel system 12*b*, as well as the other two beams although not shown, are structurally configured in the same way as described for panel system 12*a* each having the same correlated parts of the structure of the beam as described immediately above. The bottom plate 22*b* is attached to the lower inward extending flange of C-shaped beams 14*b*, 20*b*, as well as to the other two C-shaped beams, by a method of attachment that creates a leak-proof seal between the bottom plate 22*b* and each of the C-shaped beams 14*b*, 20*b* and the other two beams.

C-shaped beams 18*c*, 20*c* of panel system 12*c*, as well as the other two beams although not shown are structurally configured in the same way as described for panel system 12*a* each having the same correlated parts of the structure of the beam as described above. The bottom plate 22*c* is attached to the lower inward extending flange of C-shaped beams 18*c*, 20*c*, as well as to the other two C-shaped beams, by a method of attachment that creates a leak-proof seal between the bottom plate 22*c* and each of the C-shaped beams 18*c*, 20*c* and the other two beams.

As above, the C-shaped beams 16*d*, 18*d* of panel system 12*d*, as well as the other two beams although not shown, are structurally configured in the same way as described for panel system 12*a* each having the same correlated parts of the structure of the beam as described immediately above. In this instance, however, the bottom plate (indicated as 12*d*) is not shown so as to provide a view of the lower mounting plates or brackets that connect each of the panel systems 12*a*-12*d* together. The bottom plate 12*d* would be attached to the lower inward extending flange of C-shaped beams 16*d*, 18*d*, as well as to the other two C-shaped beams, by a method of attachment that creates a leak-proof seal between the bottom plate and each of the C-shaped beams 16*c*, 18*d* and the other two beams.

Creating the rigid orthogonal connection at the four-way joint among the adjacent panel systems 12*a*-12*d* is mounting plate 24. Mounting plate 24 extends outward from the apex of the joint overlapping not only the joint but extending over the upper flanges 13 of the C-shaped beams of each of the panel systems. Holes in the mounting plate are placed so that the holes are grouped in sets of at least two that are aligned over the center of each of the upper inward facing flanges 13 of the C-shaped beams extending outward from the vertical walls 15 of the beams. In viewing just the mounting plate 24, the holes appear to be arranged in groups of four positioned at points that are 90° apart from one another. The groups of four holes are actually two sets of two holes that will be used to bolt adjacent panel systems to each other.

Starting in the lower right of FIG. 2, panel system 12*a* presents C-shaped beam 14*a* to be placed against C-shaped beam 18*d* of panel system 12*d*. In this way the individual C-shaped beams 14*a*, 18*d*, when placed against one another, form an I-beam creating added strength for the combined panels. The mounting plate 24, with the two sets of bolts extending through the upper inward extending flanges 13*a*, 13*d* of C-shaped beams 14*a* and 18*d* hold the two C-shaped beams 14*a*, 18*d* in such close touching proximity that there is no space between them. This same method of joining the other C-shaped beams to each other is performed for each of the C-shaped beams 16*a* and 20*b*, 14*b* and 18*c*, and 20*c* and 16*d* such that each of these C-shaped beams forms an I-beam along the length of each two adjacent panel systems. However, for greater strength and rigidity, an additional bracketing system is utilized along the bottom of the panel systems 12*a*, 12*d*. The mounting plate 24 has sufficient thickness and strength to retain the panel systems 12 in position without vertical or horizontal slippage so that, along with the elongated brackets 26, 28 described more fully below, the overall interconnected structure exhibits a substantially uniform top and bottom.

Figure 3:
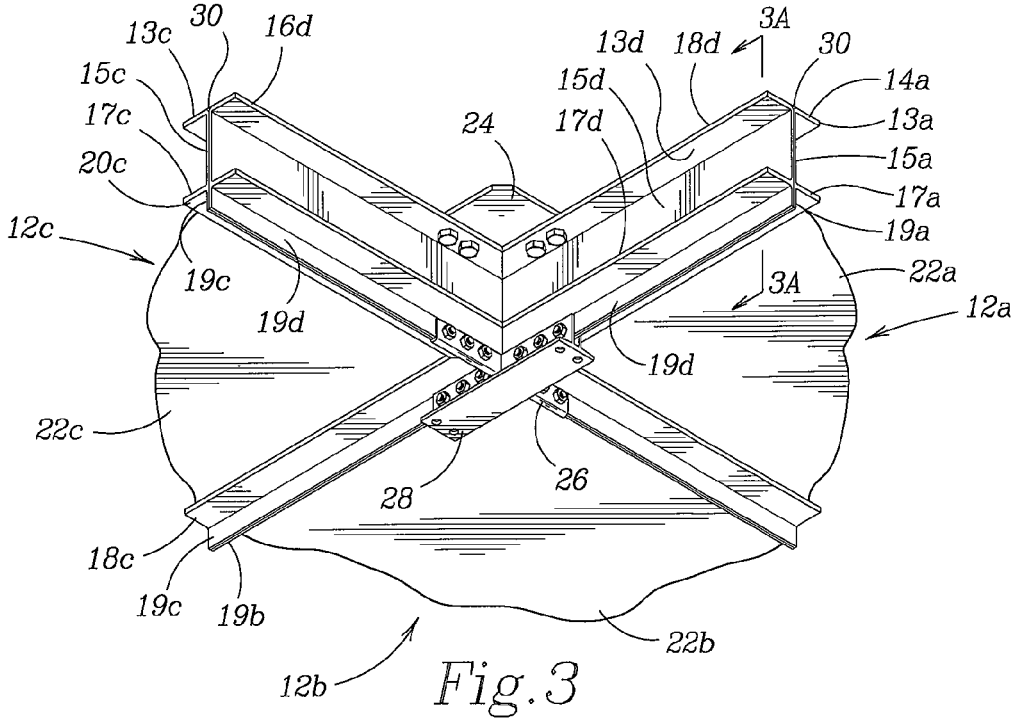
FIG. 3 is a perspective bottom view of the junction point of four adjacent panel systems of the present invention with the bottom panel of the nearest panel system not shown to show the combined top and bottom attachment mechanism for retaining a rigid leak resistant floating roof.

Referring now to FIG. 3, a first elongated bracket member 26 is positioned overlapping the bottom flanges 19*d*, 19*c* of C-shaped beams 16*d*, 20*c* and on the other side of the four-way joint overlapping the bottom flanges 19*a*, 19*b* of C-shaped beams 16*a*, 20*b*. The bracket member 26 is secured to the named C-shaped beams by using bolts extending through holes in the bracket member 26 that are coaxially aligned with holes in the bottom flanges 19 of the C-shaped beams. The holes are positioned such that they are centered vertically on the downwardly extending bottom flanges 19. The holes are spaced back from the four-way joint to allow for the chamfer on each C-shaped beam and are shown grouped in sets of three. The bracket member 26 thus retains C-shaped beams 16*d* and 20*c*, as well as 16*a* and 20*b*, in such close touching proximity that there is no space between them.

Completing the bottom portion of the four-way joint is overlying elongated bracket member 28 that is positioned and extends over a portion of bracket member 26 and overlaps the bottom flanges 19*b*, 19*c* of C-shaped beams 14*b*, 18*c* and on the other side of the four-way joint overlaps the bottom flanges 19*a*, 19*d* of C-shaped beams 14*a*, 18*d*. The overlying bracket member 28 is secured to the named C-shaped beams by using bolts extending through holes in the overlying bracket member 28 that are coaxially aligned with holes in the respective bottom flanges 19 of the C-shaped beams. The holes are positioned such that they are centered vertically on the downwardly extending bottom flanges 19. The holes are spaced back from the four-way joint to allow for the chamfer on each C-shaped beam and are shown grouped in sets of three. The overlying bracket member 28 thus retains C-shaped beams 14*b* and 18*c*, as well as 14*a* and 18*d*, in such close touching proximity that there is no space between them. When finished, the mounting plate 24 and the elongated bracket 26 and overlying elongated bracket 28 retain the four panel systems 12*a*-12*d* in a non-flexing, rigid orthogonal alignment with sufficient strength at the joint to support at least one man walking atop the panels for safety and leak inspection.

Figure 2A:
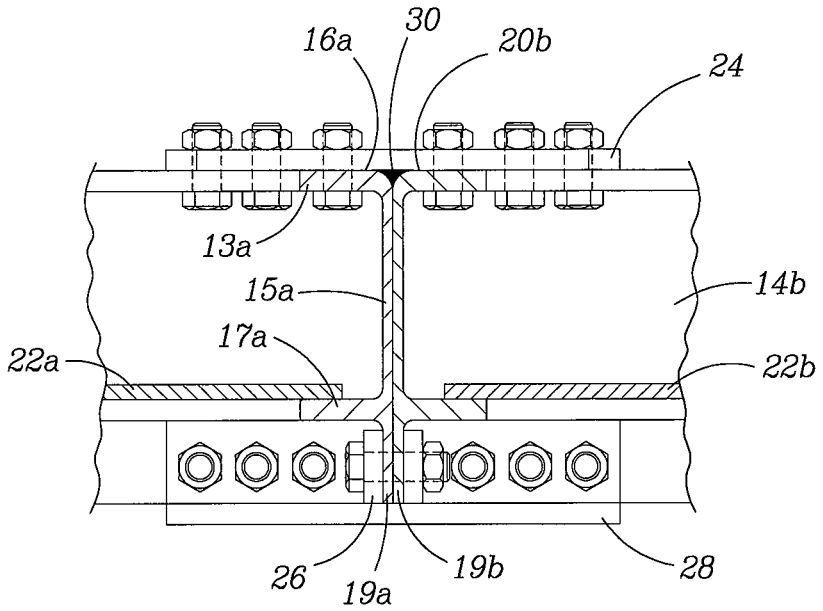
FIG. 2A is a sectional view of the junction of the four adjacent panel systems of FIG. 2 taken along Line 2A-2A.

Referring now to FIG. 2A, the view is along the axis between the C-shaped beams 16*a*, 20*b*, with C-shaped beams 14*a* and 14*b* forming the rear wall of each panel system in this view. The opposing C-shaped beams 16*a*, 20*b* are depicted with their respective vertical walls 15*a*, 15*b* and lower extending flanges 19*a*, 19*b* in touching arrangement, held in position by the upper mounting plate 24 and the elongated bracket 26. The central bolts extending through the upper flanges 13*a*, 13*b* of the C-shaped beams 16*a*, 20*b* and through the mounting bracket 24 create a rigid junction that permits no movement between the attached components. This structure is maintained for all the other upper four-way joints of the other panels systems 12 of the invention. The elongated bracket 26 retains the lower flanges 19*a*, 19*b* of the C-shaped beams 16*a*, 20*b* in touching arrangement with the sets of bolts extending through the elongated bracket 26 and through the corresponding holes in each of the flanges 19*a*, 19*b*.

Figure 3A:
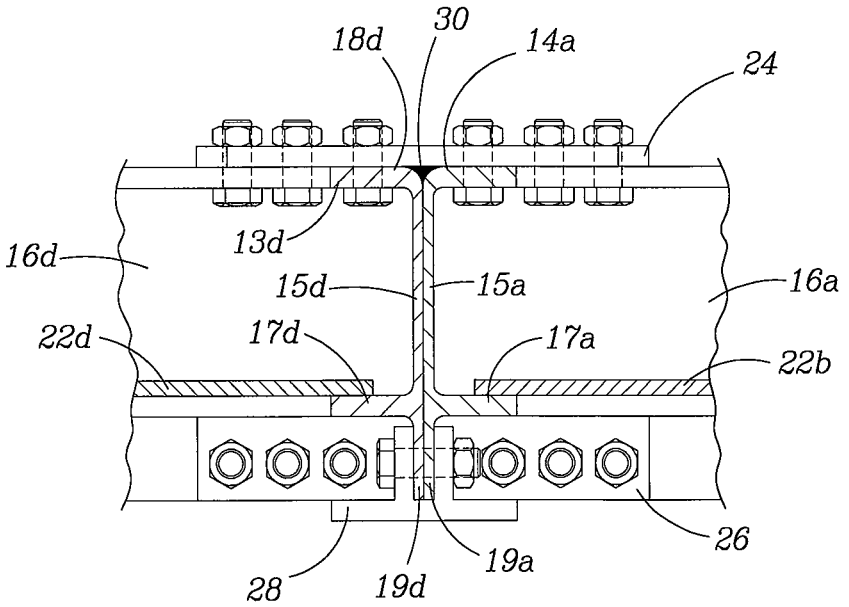
FIG. 3A is a sectional view of the junction of the four adjacent panel systems of FIG. 3 taken along Line 3A-3A.

Additionally, along the lower four-way joint the elongated bracket 26 is assisted in retaining the panel systems 12 in orthogonal relationship by overlying elongated bracket 28. Referring to FIG. 3A, the view is taken along the axis between the C-shaped beams 14*a*, 18*d*, with C-shaped beams 16*a* and 16*d* forming the rear wall of each panel system in this view. The overlying elongated bracket 28 extends over the underside of bracket 26 and captures both downwardly extending flanges 19*a*, 19*d* between its upstanding bracket walls. The overlying elongated bracket 28 retains the lower flanges 19*a*, 19*d* of the C-shaped beams 14*a*, 28*d* in touching arrangement with the sets of bolts extending through the overlying elongated bracket 28 and through the corresponding holes in each of the flanges 19*a*, 19*d*. The combination of the elongated bracket 26 and the overlying elongated bracket 28 create a rigid junction that permits no movement between the attached components. This structure is maintained for all the other lower four-way joints of the other panels systems 12 of the invention. The brackets 26, 28 have sufficient thickness and strength to retain the panel systems 12 in position without vertical or horizontal slippage so that the overall interconnected structure exhibits a substantially uniform top and bottom.

The specific arrangement for the attachment of adjacent panel systems 12 to each other is designed to prevent the unwanted escape of gases or vapors through a potential pathway between the facing sidewalls of the C-shaped beams 14, 16, 18, 20 of adjacent panel systems. None of the holes for accepting fasteners are created to penetrate the vertical sidewalls 15 of the panel systems 12. The top joint of the adjacent panel systems 12 is made with the use of mounting plate 24 that overlays each of the upper flanges 13 with the fastener mounting holes penetrating only the mounting plate 24 and the flanges 13. This is made possible by eliminating the top sealing plate in each panel system 12. Further, the bottom joint of the adjacent panel systems 12 is made with the use of cooperating mounting brackets 26, 28 which are positioned below the surface of the contained fluid and, although fastener mounting holes penetrate the vertical sidewall extensions 19, these holes cannot cause gas or vapor leaks since they are located below the surface of the contained fluid. Therefore, the C-shaped beams used in the panel systems 12, when forming the sidewalls 15 of each panel system 12 and placed in adjacent abutting positions for interconnection, have no holes or other apertures existing between the upper and lower flanges 13, 17 that could create alternative pathways for the escape of volatile gases or vapors. The interconnection of the panel systems 12 described above virtually eliminates any potential pathway for the escape of volatile gases or vapors between or through any of the panel systems while providing an interconnected structure having sufficient structural integrity to permit walking along the top of the structure without slippage or warpage of the various panel systems 12.

The structure of each panel system 12 is repeated for each of the panel systems shown in FIG. 1 for the internal floating roof system. The four-way joint described in connection with FIGS. 2, 2A and 3, 3A is repeated at each four-way joint throughout the internal floating roof to join the adjacent panel systems 12 together as a rigid non-flexing structure. However, along the perimeter of the internal floating roof 10, there are a number of partial panel systems that have been truncated to conform to the outer perimeter curvature requirement of the internal floating roof and the need to conform to the curvature of the inner walls of the tank or other container system with which the floating roof is utilized. A partial panel system 32 is marked in FIG. 1 and will be described in more detail below.

Figure 4:
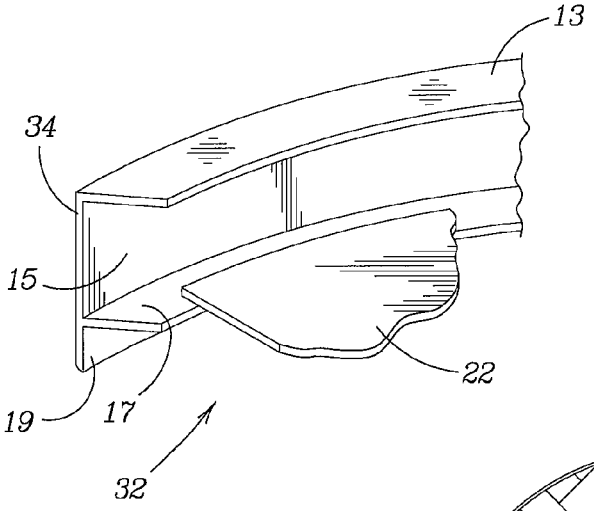
FIG. 4 is a partially broken away view of a roof edge panel of the floating roof of FIG. 1.

Referring to FIG. 4, the partial panel system 32 is structurally configured the same as the panel systems 12, excepting that the outer C-shaped beam 34 is curved to match the curvature of the tank or container system in which the internal floating roof 10 will be used. The curved C-shaped beam 34 has an upper inwardly extending flange 13, a vertical wall section 15 and an inwardly extending lower flange 17 just as the other C-shaped beams. Curved C-shaped beam 34 also has a downwardly extending bottom flange 19 for use in bolting the panel systems 12, 32 together as described above.

As with each of the other C-shaped beams, curved C-shaped beam 34 is chamfered at its distal ends in relation to the next adjacent beam in order that their opposing ends can be joined together without overlapping parts. Extending across the bottom of the panel system 32 and lying atop the lower inward facing portion of the C-shaped beams is a bottom plate 22 that extends across the entire space formed between the C-shaped beams overlapping a portion of the lower portion of the C-shaped beams. The bottom plate 22 is attached to each of the C-shaped beams along its perimeter forming a leak-proof panel system that is open on its top facing side in the same manner as the other panel systems 12.

Although the bolting scheme using the mounting plate 24 and the elongated brackets 26, 28 for interlocking the panel systems 12, 32 creates an extremely tight fitting wall abutment between adjacent panels 12, 32, there may still be some vapor leakage between the C-shaped outer wall segments of the panel systems 12, 32. In order to further reduce the potential for leakage, if the C-shaped beams of a suitable rigid material (metallic, etc.) are utilized, a running weld 30 along the top side of the joint between two adjacent C-shaped beams is laid down. In the preferred embodiment, the weld 30 is not required to assist the structural integrity of the panel system, but only as a barrier to gaseous or vapor leak through between the C-shaped beams. Another method of reducing the potential for leakage is to insert a resilient seal or caulk along the top of the joint between two adjacent C-shaped beams when bolting them together. The material for the weld or the resilient seal 30 is selected so as to be chemically resistant to the stored liquid in order to retain its function of preventing unwanted escape of harmful gas or vapors.

The C-shaped beams can be made from metal such as aluminum, steel, stainless steel or alloys of the same where the metals or alloys are resistant to corrosion from the chemical, hydrocarbon liquid or other liquid in the tank or container system. Other substances can be used such as extruded fiberglass, carbon or graphite composites and similar synthetic structural components having appropriate physical characteristics. These composite materials, while much lighter in weight, must also be resistant to the corrosive effects of the liquids with which they will be used.

Figure 5:
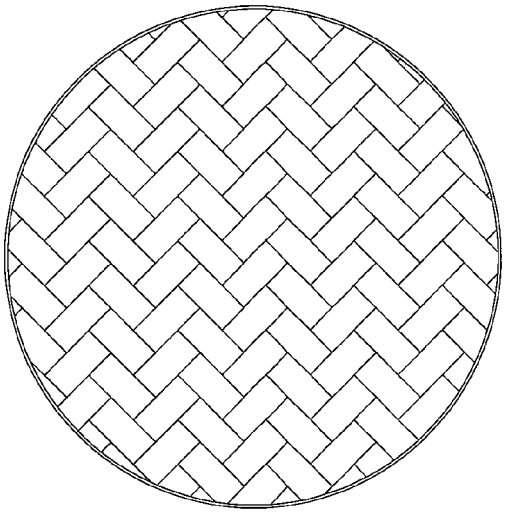
FIG. 5 is a plan view of the floating roof panels arrayed in a herringbone pattern.
Figure 6:
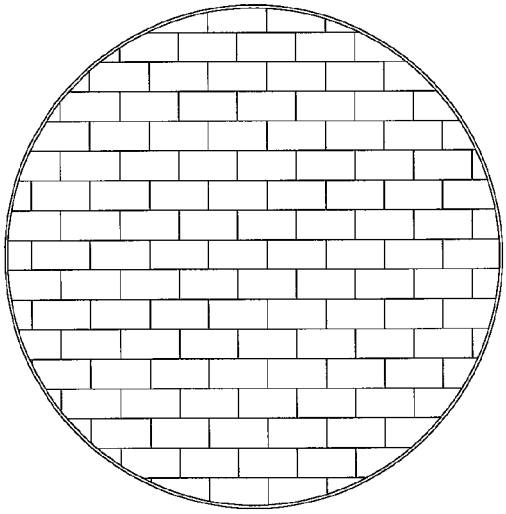
FIG. 6 is a plan view of the floating roof panels arrayed in a running brick pattern.

Although the internal floating roof 10 is shown in FIG. 1 in a checker board pattern, other layouts and arrangement are possible. The internal floating roof 10 may also be structured in the herringbone pattern of FIG. 5 or the running brick pattern of FIG. 6. If these patterns are utilized, then the mounting plate 24 and the brackets 26, 28 are modified to accept the three-way joint among the adjacent panel systems 12.

The internal floating roof 10 of the present invention is constructed from a plurality of interlocked panel systems 12 that contain no enclosed spaces. Without enclosed spaces, the internal floating roof 10 can exhibit a lower vertical profile that results in spatial gains both above and below the floating roof. Without enclosed spaces, safety inspections for leaks take less time. The method of interlocking the panel systems 12 creates a much tighter seam between each said panel system, which is augmented by either a weld or resilient sealant system. This is accomplished without creating any holes in the outer vertical walls of the panel systems 12 above the level of the contained fluid to accommodate fasteners for connecting each panel system to another, which results in lower emissions, i.e., leakage of harmful gases and vapors. The internal floating roof 10 with the open interlocked panel systems 12 is designed, when structurally interlocked, to provide a structural strength and integrity so that walking across the floating roof on the joined C-shaped beams of the interconnected panel systems 12 will not cause excessive flexure of the roof or panel systems.

The present invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraced therein.

The invention claimed is:

1. A full contact internal floating roof comprising:

a plurality of interconnected panel systems, each panel system comprising at least three or more C-shaped beams having an upper inwardly extending flange, a lower inwardly extending flange, an orthogonally positioned connecting wall extending between said upper and lower inwardly extending flanges, a bottom flange extending the connecting wall downward from and orthogonal to the lower inwardly extending flange, and a flat bottom panel extending across the space defined by the C-shaped beams of the panel system attached to the lower inwardly extending flanges of the at least three or more C-shaped beams leaving the remaining upwardly extending internal space open to the atmosphere; defined by the at least three or more C-shaped beams a plurality of brackets for securing together adjacent panel systems at their respective top and bottom corners so that adjacent panel systems are held in an abutting array at the intersection of at least three or more adjacent panel systems, said brackets consisting of an upper bracket overlying and secured to the upper inwardly facing flange of each of the C-shaped beams of each adjacent panel system and a pair of lower brackets arranged at right angles to each other overlying and secured about the bottom flanges of each of the C-shaped beams at the intersection of the at least three or more adjacent panel systems;

whereby the plurality of panel systems are retained in sealing engagement against each adjacent panel system along their common sidewalls such that the abutting C-shaped beams form I-shaped beams creating a rigid, non-flexing floating roof structure minimizing vapor leaks.

2. The full contact internal floating roof of claim 1, wherein said upper bracket overlies the intersectional junction of the at least three or more adjacent panel systems securing the panel systems together in abutting array along their respective connecting sidewalls by securing means extending through the upper bracket and the upper inwardly extending flanges of the adjacent panel systems.

3. The full contact internal floating roof of claim 1, wherein said lower brackets overlie the intersectional junction of the at least three or more adjacent panel systems securing the panel systems together in abutting array along their respective connecting sidewalls by securing means extending through the lower brackets and the bottom flanges of the adjacent panel systems.

4. The full contact internal floating roof of claim 1, further comprising panel systems along the perimeter of the floating roof that includes one C-shaped beam having a curvature that matches the curvature of the container in which the floating roof is being used.

5. The full contact internal floating roof of claim 1, further comprising an additional sealing means positioned atop the entire length of the abutting C-shaped beams of adjacent panel systems for further reducing any potential leakage of harmful gases or vapors.

6. The full contact internal floating roof of claim 5, wherein the additional sealing means is a weld positioned along the entire length of the top joint of the abutting connecting sidewalls of the C-shaped beams of adjacent panel systems.

7. The full contact internal floating roof of claim 5, wherein the additional sealing means is a resilient caulk positioned along the entire length of the top joint of the abutting connecting sidewalls of the C-shaped beams of adjacent panel systems.

8. A full contact internal floating roof comprising:

a plurality of panel systems, each panel system comprising at least three or more outwardly facing sidewalls, each sidewall having a lower inwardly extending flange and a flat bottom panel extending across the space defined by the sidewalls leaving the remaining upwardly extending space open to the atmosphere;

a plurality of means for securing together adjacent panel systems at the intersection of at least three or more adjacent panel systems at their respective top and bottom edges so that the adjacent panel systems are held in an abutting array;

whereby the plurality of panel systems are retained in sealing engagement against each adjacent panel system along their common sidewalls creating a rigid, non-flexing floating roof structure creating a rigid, non-flexing floating roof structure minimizing vapor leaks.

9. The full contact internal floating roof of claim 8, wherein said means for securing together adjacent sidewalls is selected from the group consisting of welding and mechanical fastening.

10. The full contact floating roof of claim 8, further comprising panel systems along the perimeter of the floating roof that includes one outwardly facing sidewall having a curvature that matches the curvature of the container in which the floating roof is being used.

* * * * *